US009743181B2

(12) United States Patent
Choisel et al.

(10) Patent No.: US 9,743,181 B2
(45) Date of Patent: Aug. 22, 2017

(54) LOUDSPEAKER EQUALIZER

(71) Applicant: Apple Inc., Cupertino, CA (US)

(72) Inventors: Sylvain J. Choisel, San Francisco, CA (US); Martin E. Johnson, Los Gatos, CA (US); Jack Y. Dagdagan, Worms, DE (US)

(73) Assignee: APPLE INC., Cupertino, CA (US)

( * ) Notice: Subject to any disclaimer, the term of this patent is extended or adjusted under 35 U.S.C. 154(b) by 18 days.

(21) Appl. No.: 14/989,727

(22) Filed: Jan. 6, 2016

(65) Prior Publication Data

US 2017/0195790 A1 Jul. 6, 2017

(51) Int. Cl.

| | |
|---|---|
| ***H04R 3/00*** | (2006.01) |
| ***H04R 29/00*** | (2006.01) |
| ***H04R 3/04*** | (2006.01) |
| ***H04R 1/02*** | (2006.01) |
| ***H04R 1/28*** | (2006.01) |

(52) U.S. Cl.
CPC ..... *H04R 3/04* (2013.01); *H04R 1/025* (2013.01); *H04R 1/2884* (2013.01); *H04R 29/001* (2013.01)

(58) Field of Classification Search
CPC ..... H04R 3/04; H04R 1/2884; H04R 29/001; H04R 1/025
See application file for complete search history.

(56) References Cited

U.S. PATENT DOCUMENTS

| | | | | |
|---|---|---|---|---|
| 5,588,065 | A | 12/1996 | Tanaka et al. | |
| 7,092,535 | B1 | 8/2006 | Pedersen et al. | |
| 8,160,282 | B2 | 4/2012 | Christoph et al. | |
| 2003/0194097 | A1 | 10/2003 | Ding | |
| 2006/0088174 | A1 | 4/2006 | DeLeeuw et al. | |
| 2008/0107287 | A1* | 5/2008 | Beard | H04R 1/1016 381/111 |

(Continued)

FOREIGN PATENT DOCUMENTS

| | | | |
|---|---|---|---|
| EP | 0658064 | A2 | 6/1995 |
| EP | 0772374 | A2 | 5/1997 |

OTHER PUBLICATIONS

Lee, J.S. et al., "On the method for estimating the volume velocity of an acoustic source in a chamber", J. of Sound and Vibration (1995) 182(4), pp. 505-522.

*Primary Examiner* — Muhammad N Edun
(74) *Attorney, Agent, or Firm* — Blakely, Sokoloff, Taylor & Zafman LLP

(57) ABSTRACT

A loudspeaker system includes a driver in an enclosure that provides a back volume which is sealed with respect to acoustic pressure waves produced by a driver diaphragm. An external microphone is located outside the back volume. An internal microphone located inside the back volume. A computational unit is coupled to the external microphone and the internal microphone and configured to determine a transfer function for an equalization filter. The transfer function determination is responsive to the external microphone and the internal microphone. A digital signal processor is coupled to a signal source, the driver, and the computational unit. The digital signal processor is configured to implement the equalization filter as determined by the computational unit, create a filtered audio signal from the signal source, and provide the filtered audio signal to the driver.

30 Claims, 1 Drawing Sheet

(56) References Cited

U.S. PATENT DOCUMENTS

| | | | | |
|---|---|---|---|---|
| 2014/0003645 | A1* | 1/2014 | Silver | H04R 1/2803<br>381/351 |
| 2015/0237440 | A1* | 8/2015 | Fromel | H04R 1/00<br>381/334 |
| 2017/0077887 | A1* | 3/2017 | You | H03G 3/32 |

* cited by examiner

LOUDSPEAKER EQUALIZER

BACKGROUND

Field

Embodiments of the invention relate to the field of processing systems for audio signals in loudspeakers; and more specifically, to processing systems designed to compensate for an undesired amplitude-frequency characteristic of the loudspeaker system.

Background

The sound quality of loudspeakers is known to be affected by the room they are placed in. At lower frequencies (typically below a few hundred Hz, e.g., below 500 Hz), the proximity of boundaries (walls, large furniture) will cause significant boosts and dips in the frequency-dependent acoustic power radiated into the room.

These effects are strongly dependent on the position of the loudspeaker within the room. A corner placement, for instance, will cause a significant increase in radiated acoustic power at low frequencies, causing the sound to be overly bassy or muddy. The position of the listener's ears with respect to room boundaries will affect the perceived frequency response in a similar manner.

In order to compensate for these effects, and produce a neutral or more balanced frequency response, digital equalization may be used. Many commercially available solutions require measurements at or around the listening positions, requiring the user to move a microphone around the listening environment during setup.

Other solutions make use of microphones built into the loudspeaker system that monitor the radiation in the vicinity of the loudspeaker diaphragm in order to infer a global response, e.g. an estimate of the total acoustic power radiated into the room. Such solutions are described in U.S. Pat. No. 7,092,535 B1 and EP 0772374 B1. A drawback of a global equalization is that a specific, desired, frequency response cannot be achieved at any one location in the room. The advantages, however, may make it a desirable solution for many applications:

1) no microphone has to be moved around by the user;
2) a fixed listening position does not have to be assumed, which will not require a new calibration when the user moves;
3) it is more suitable for a multi-listener setup, a room where listeners move around or where several listening positions exist (such as a sofa and a dining table);
4) it significantly lowers the risk of making the frequency response worse at listening positions that were not measured.

These global equalization solutions require the estimation of pressure and velocity to estimate the radiation resistance $R_{rad}(f)$, the real part of the radiation impedance $Z_{rad}(f)$, which may calculated as:

$$R_{rad}(f)=Re\{Z_{rad}(f)\}$$

$$=Re\{p(f)/U(f)\}$$

where p(f) is the pressure in front of the loudspeaker and U(f) is the volume velocity.

In prior art global equalization solutions, the volume velocity has been estimated from the gradient of pressure in front of the loudspeaker, e.g. by taking a measurement at two distinct positions. Methods relying on pressure gradient require strict tolerances on the microphone matching, or require moving parts if a single microphone is to be employed. They also give little room for design freedom in terms of microphone placement.

Another method used in prior art global equalization solutions is to place an accelerometer on the loudspeaker diaphragm. Because the acceleration signal has to be integrated (to produce a velocity signal), any noise in the measurement will cause an accumulated error.

It would be desirable to provide an easier and more effective way to provide a global equalization for a driver to produce a more balanced frequency response responsive to the environment in which the loudspeaker system is placed.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

In the following description, reference is made to the accompanying drawings, which illustrate several embodiments of the present invention. It is understood that other embodiments may be utilized, and mechanical compositional, structural, electrical, and operational changes may be made without departing from the spirit and scope of the present disclosure. The following detailed description is not to be taken in a limiting sense, and the scope of the embodiments of the present invention is defined only by the claims of the issued patent.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
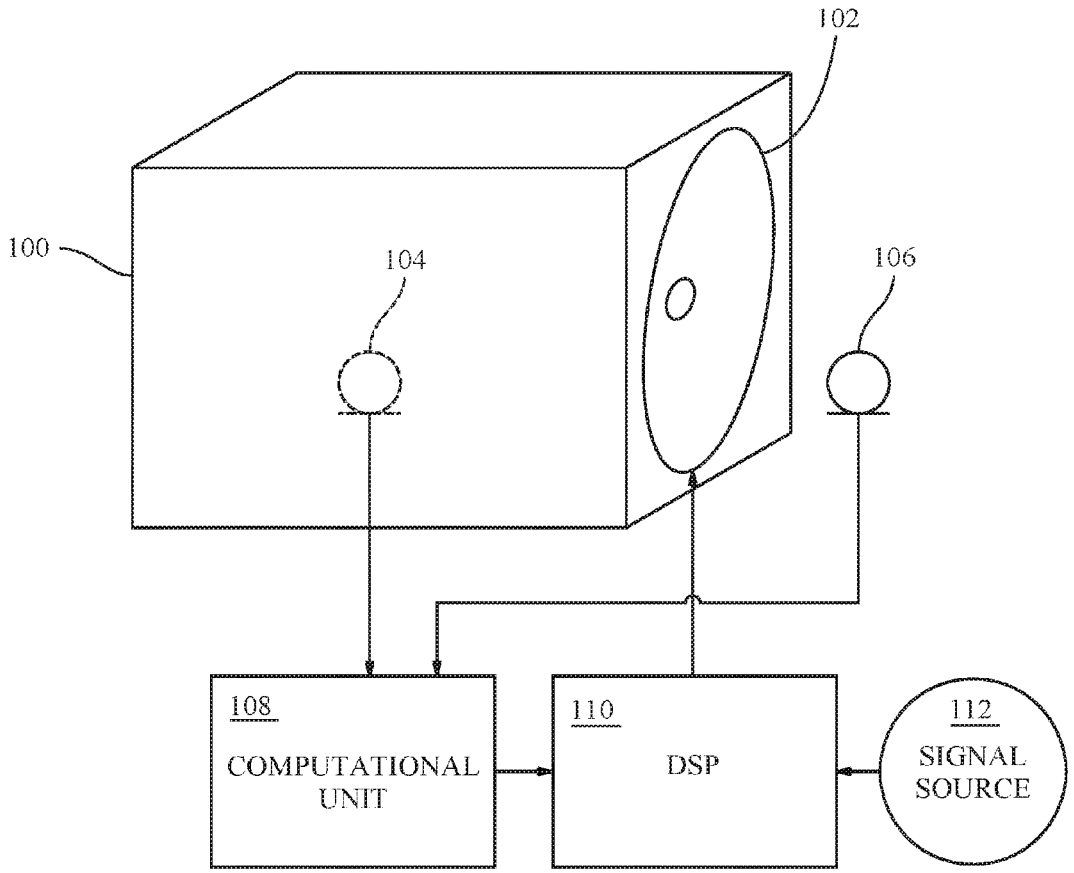
FIG. 1 is a block diagram of a loudspeaker system.

FIG. 1 is a view of an illustrative loudspeaker system containing a driver 102, which may be a low frequency driver such as a woofer or a sub-woofer. The driver is in a "sealed" enclosure 100 that creates a back volume. The back volume is the volume inside the enclosure 100. "Sealed" indicates that the back volume does not transfer air to the outside of the enclosure 100 at the frequencies at which the driver operates. The enclosure 100 has a small leak so internal and external pressures can equalize over time, to compensate for changes in barometric pressure or altitude. A porous paper speaker cone, or an imperfectly sealed enclosure may provide this slow pressure equalization. The enclosure 100 may have dimensions that are much less than the wavelengths produced by the driver.

The loudspeaker system includes a pair of microphones. One microphone, which may be referred to as the internal microphone 104, is placed inside the back volume of the speaker enclosure 100. The other microphone, which may be referred to as the external microphone 106, is placed outside the speaker enclosure 100. The external microphone 106 is located to measure acoustic pressure in the vicinity of the driver. The internal microphone 104 is used to indirectly measure volume velocity of the loudspeaker diaphragm. In some embodiments, two or more external microphones are provided and the measurements from the two or more external microphones are combined.

The loudspeaker system further includes a computational unit 108 and a digital signal processor (DSP) 110. The computational unit may be a microprocessor or microcontroller and it may be optimized for the computation of transfer functions. The DSP may be optimized for the processing of digital or analog audio signals and configurable according to the computed transfer functions. The computational unit and the DSP may be implemented with the same hardware in some embodiments. In some embodiments the computational unit 108 and/or the DSP 110 are located in or on the enclosure 100. In some other embodiments the computational unit 108 and the DSP 110 are provided as a signal processor that is separate from the loudspeaker system.

The DSP 110 provides an adaptive equalization filter that receives an audio signal from an external signal source 112, such as an amplifier coupled to the loudspeaker system, and provides a filtered audio signal to the driver 102 of the loudspeaker system.

The computational unit 108 is coupled to the external microphone 106 and the internal microphone 104. The computational unit 108 is configured to determine an equalization filter responsive to the external microphone 106 and the internal microphone 104. The adaptive equalization filter is implemented by the DSP 110 as determined by the computational unit 108 to produce a more balanced frequency response responsive to the environment in which the loudspeaker system is placed. The computational unit 108 may estimate a volume velocity of the loudspeaker diaphragm by using the instantaneous pressure in the back volume measured by the internal microphone 104.

Assuming a sealed box, at low frequencies having wavelengths significantly larger than the dimension of the box, the sound field inside the enclosure 100 is a pressure field. The instantaneous pressure is uniform and varies in phase with the displacement of the loudspeaker. In some embodiments, the loudspeaker displacement may be estimated for frequencies at which the pressure-field assumption is not strictly valid, by using a compensation filter to account for the propagation between the loudspeaker diaphragm and the internal microphone. This is suitable at frequencies below the first resonance of the enclosure, or if the internal microphone is placed away from any pressure notch in the enclosure.

If an adiabatic process, i.e. one in which no heat is transferred into or out of the woofer enclosure 100 while the pressure inside of the enclosure fluctuates, is assumed, the adiabatic gas law may be used to estimate the speaker displacement using an estimate of the pressure inside the enclosure 100 based on the internal microphone signal. The adiabatic gas law for an ideal gas states that pressure p and volume V are exponentially related:

$$pV^{\gamma}=k(\text{constant})$$

where $\gamma=7/5$ for a diatomic gas (valid for air).

The loudspeaker diaphragm 102 can be modeled as a piston (with a surface area S) moving back and forth with instantaneous displacement x(t) around its rest position.

Figure 2:
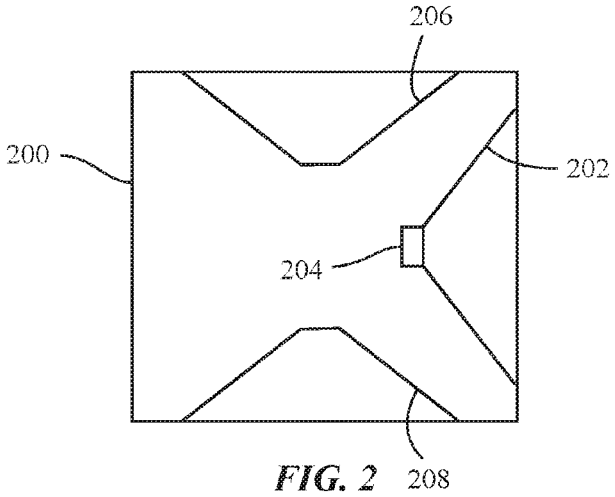
FIG. 2 is a schematic cross-section of a loudspeaker that includes passive drivers.

FIG. 2 is a schematic cross-section of a loudspeaker 200 that includes passive radiators 206, 208 in addition to a driven loudspeaker 202. The driven loudspeaker 202 includes a motor 204, such as a voice coil motor, that moves the diaphragm 202 in response to an electrical signal. The passive radiators 206, 208 are moved by the acoustic pressure waves created by the driven loudspeaker 202. In a loudspeaker 200 that includes passive radiators 206, 208 the surface area S is the total surface area of the driven and passive diaphragms. The loudspeaker 200 that includes passive radiators 206, 208 includes internal and external microphones, a computational unit, and a DSP similar to those illustrated in FIG. 1.

The movement of the diaphragm(s) causes changes to the volume inside the enclosure 100, that can be written as:

$$V(t)=V_0+Sx(t)$$

where $V_0$ is the volume of the woofer enclosure when the woofer is at rest. Combining this relationship with the adiabatic gas law relationship, an expression for the instantaneous displacement x(t) can be derived:

$$V(t)=\left(\frac{k}{p(t)}\right)^{1/\gamma}$$

$$V_0+Sx(t)=\left(\frac{k}{p(t)}\right)^{1/\gamma}$$

$$x(t)=\left(\left(\frac{k}{p(t)}\right)^{1/\gamma}-V_0\right)\Big/S$$

The constant k can be derived from the conditions at rest:

$$k=P_0V_0$$

where $P_0$ is the atmospheric pressure.

The volume velocity U is equal to the product of the diaphragm velocity u and the diaphragm surface area S:

$$U(t)=Su(t)$$

-continued $$U(t) = S\left(\frac{dx(t)}{dt}\right)$$

$$U(t) = \frac{d}{dt}\left(\left(\frac{k}{p(t)}\right)^{1/\gamma}\right)$$

The instantaneous, absolute, pressure p(t) can be estimated from the internal microphone signal $p_{int}(t)$:

$$p(t)=p_{int}(t)+P_0$$

where $P_0$ is the atmospheric pressure (a small leak always exists in a closed speaker system that will cause the internal pressure to return to $P_0$ at rest).

In another embodiment the instantaneous speaker displacement x(t) may be estimated using an estimate of the pressure inside the enclosure 100 based on the internal microphone signal and the following relationships, which are small parameter approximations to the equation given above for x(t) where $Sx(t)<<V_0$:

$$x(t)=(-p_{int}V_0)/(\rho_0 c^2 S)$$

$$x(t)=(-p_{int}V_0)/(7/5P_0S)$$

where $\rho_0$ is the density of air and c is the speed of sound. The volume velocity U is then calculated by differentiating the displacement:

$$U(t) = S\left(\frac{dx(t)}{dt}\right)$$

The radiation impedance $Z_{rad}(f)$ at a given frequency f can be derived with the following equation, using the estimated external pressure $p_{ext}(f)$ in the vicinity of the loudspeaker and the volume velocity U(f) determined from the external microphone signal and the relationships above:

$$Z_{rad}(f)=P_{ext}(f)/U(f)$$

A transfer function $H_{eq}(f)$ for the equalization filter is calculated based on the ratio of a target power in a reference acoustic condition (e.g. a reference room) $P_{rad_ref}$ and the estimated radiated acoustic power in the current acoustic environment of the loudspeaker $P_{rad_actual}$. The acoustic power is proportional to the real part of the radiation impedance. The transfer function may be determined based on radiation impedances using the following equations:

$$H_{eq}(f) = \sqrt{\frac{P_{rad_ref}}{P_{rad_actual}}}$$

$$H_{eq}(f) = \sqrt{\frac{\mathrm{Re}\{Z_{rad_ref}(f)\}}{\mathrm{Re}\{Z_{rad_actual}(f)\}}}$$

where $Z_{rad_ref}$ is a predetermined radiation impedance either derived theoretically, measured in a reference acoustic condition, or an average of radiation impedances measured in several acoustic conditions, and $Z_{rad_actual}$ is the radiation impedance estimated in the current acoustic environment of the loudspeaker using the external microphone signal. In embodiments that include two or more external microphones, a radiation impedance may be calculated for each of the external microphones, and the two or more radiation impedances may be averaged to estimate the radiation impedance for the loudspeaker.

The estimation of radiation impedance is more consistent for lower frequencies, where the threshold for consistent estimations depends on the dimensions of the loudspeaker system. If the dimensions of the loudspeaker system and all distances were to be halved, the threshold frequency for consistent radiation impedance estimates would be doubled. The radiated pressure is measured close to the driver and the pressure is assumed to be spatially uniformly distributed, an assumption that holds only up to a certain frequency for a certain driver. A smaller driver may radiate spatially uniform pressures up to a higher frequency than a bigger driver. Further, the sealed volume has to be small compared to the wavelength of the highest frequency at which the radiation resistance is still consistent. Equalizing for the gain from nearby boundaries becomes unnecessary at frequencies much higher than 400 Hz, since the gain from nearby boundaries attenuates to an insignificant amount at about 500 Hz. For these reasons, the effect of the equalization filter may be limited to a range of frequencies, for example 50 to 400 Hz.

Some embodiments include two or more loudspeaker systems each of which includes a driver. In such embodiments, there is a radiation impedance between each source i and sink j that may be derived from the following relationship:

$$Z_{rad_ij}=p_{ij}/U_i$$

One or more computational units 108 and digital signal processors (DSPs) 110 may provide adaptive equalization filters that receive audio signals from an external source, such as an amplifier coupled to the loudspeaker systems, and provide filtered audio signals to the drivers of the two or more loudspeaker systems.

In some embodiments including two or more loudspeaker systems, a single equalization filter transfer function $H_{eq}(f)$ is calculated and used to provide an adaptive equalization filter implemented by the DSP for each of the loudspeaker systems.

In a first embodiment including two or more loudspeaker systems, each of the loudspeakers provides an audio output in turn while all loudspeakers estimate the external pressure $p_{ext}(f)$ in their vicinity for each of audio outputs. In these embodiments the estimated radiated acoustic power may be determined from the following relationship:

$$P_{rad1}(f)=U(f)'\times Re\{Z_{rad}(f)\}\times U(f)$$

where U(f)' is the hermitian transpose of U(f).

In a second embodiment including two or more loudspeaker systems, all of the loudspeakers provide the same audio output and estimate the external pressure $p_{ext}(f)$ in their vicinity simultaneously. In these embodiments the estimated radiated acoustic power must be divided by the number of speakers N:

$$P_{rad2}(f)=U(f)'\times Re\{Z_{rad}(f)\}\times U(f)/N$$

In a third embodiment including two or more loudspeaker systems, the goal is to minimize the total electric power by giving higher weights, in each frequency band, to loudspeaker(s) that have higher radiation resistance to provide an optimal acoustic power distribution. This is suitable for low frequencies where all speakers will play the same content.

In a fourth embodiment including two or more loudspeaker systems, adaptive equalization filters are provided such that each of the two or more loudspeakers contributes the same acoustic power. This balanced speaker contribution may be desirable at higher frequencies where one of the speakers may be heard more than the others because its radiation impedance is higher.

For a single loudspeaker system and the second, third, and fourth embodiments including two or more loudspeaker systems, the calculations of radiation impedances may be done in real time while a normal audio program is playing. This allows the sound quality of the loudspeaker systems to be optimized without the need for a dedicated calibration sequence using artificial test signals.

In a fifth embodiment including two or more loudspeaker systems, combinations of two or more of the preceding embodiments including two or more loudspeaker systems may be used. Each of the preceding embodiments included in such a combination is applied in a different frequency band.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. A loudspeaker system comprising:

a driver;

an enclosure for the driver that provides a back volume which is sealed with respect to acoustic pressure waves produced by a driver diaphragm;

an external microphone located outside the back volume;

an internal microphone located inside the back volume;

a computational unit coupled to the external microphone and the internal microphone, the computational unit configured to determine a transfer function for an equalization filter, the transfer function determination being responsive to the external microphone and the internal microphone; and a digital signal processor coupled to a signal source, the driver, and the computational unit, the digital signal processor configured to implement the equalization filter as determined by the computational unit, create a filtered audio signal from the signal source, and provide the filtered audio signal to the driver.

2. The loudspeaker system of claim 1, wherein the external microphone is located to measure the acoustic pressure in a vicinity of the driver.

3. The loudspeaker system of claim 1, wherein the computational unit is configured to compute an estimate of volume velocity for the driver diaphragm using an estimate of instantaneous pressure in the back volume based on a measurement from the internal microphone and determines the transfer function responsive to the estimate of volume velocity.

4. The loudspeaker system of claim 1, wherein the computational unit is configured to determine the transfer function based on a ratio of a target power in a reference acoustic condition and an estimated radiated acoustic power in a current acoustic environment of the loudspeaker system.

5. The loudspeaker system of claim 1, wherein the computational unit is configured to determine the transfer function based on a ratio of a predetermined radiation impedance and a radiation impedance estimated in a current acoustic environment of the loudspeaker system.

6. The loudspeaker system of claim 5, wherein the predetermined radiation impedance is measured in a reference acoustic condition.

7. The loudspeaker system of claim 5, wherein the predetermined radiation impedance is an average of radiation impedances measured in several acoustic conditions.

8. The loudspeaker system of claim 1, wherein frequencies of acoustic pressure waves of interest produced by the driver are below a first resonance of the enclosure.

9. The loudspeaker system of claim 1, wherein the internal microphone is located away from a notch of a standing wave produced by the driver in the back volume of the enclosure.

10. The loudspeaker system of claim 1, wherein the enclosure has a leak that allows a pressure in the back volume to equalize with an ambient pressure at a slow rate.

11. The loudspeaker system of claim 1, wherein the external microphone is located to measure the acoustic pressure in a vicinity of the driver.

12. The loudspeaker system of claim 1, wherein the computational unit is configured to estimate a volume velocity for the driver diaphragm using an estimate of instantaneous pressure in the back volume based on a measurement from the internal microphone.

13. The loudspeaker system of claim 1, wherein the computational unit is configured to determine the equalization filter.

14. The loudspeaker system of claim 1, further comprising a passive radiator.

15. A signal processor for a loudspeaker system, the signal processor comprising:

a computational unit coupled to an external microphone and an internal microphone, the external microphone located outside a back volume of an enclosure for a driver, the internal microphone located inside the back volume, the back volume being sealed with respect to acoustic pressure waves produced by the driver, the computational unit configured to determine an equalization filter responsive to the external microphone and the internal microphone; and a digital signal processor coupled to a signal source, the driver, and the computational unit, the digital signal processor configured to implement the equalization filter as determined by the computational unit, create a filtered audio signal from the signal source, and provide the filtered audio signal to the driver.

16. The signal processor of claim 15, wherein the external microphone is located to measure the acoustic pressure in a vicinity of the driver.

17. The signal processor of claim 15, wherein the computational unit is configured to compute an estimate of volume velocity for a driver diaphragm using an estimate of instantaneous pressure in the back volume based on a measurement from the internal microphone and determines the equalization filter responsive to the estimate of volume velocity.

18. The signal processor of claim 15, wherein the computational unit is configured to determine the equalization filter based on a ratio of a target power in a reference acoustic condition and an estimated radiated acoustic power in a current acoustic environment of the loudspeaker system.

19. The signal processor of claim 15, wherein the computational unit is configured to determine the equalization filter based on a ratio of a predetermined radiation impedance and a radiation impedance estimated in a current acoustic environment of the loudspeaker system.

20. The signal processor of claim 19, wherein the predetermined radiation impedance is measured in a reference acoustic condition.

21. The signal processor of claim 19, wherein the predetermined radiation impedance is an average of radiation impedances measured in several acoustic conditions.

22. The signal processor of claim 15, wherein the external microphone is located to measure the acoustic pressure in a vicinity of the driver.

23. The signal processor of claim 15, wherein the computational unit is configured to estimate a volume velocity for a driver diaphragm using an estimate of instantaneous pressure in the back volume based on a measurement from the internal microphone.

24. The signal processor of claim 15, wherein the computational unit is configured to determine the equalization filter.

25. A loudspeaker system comprising:

a driver;

an amplifier coupled to the driver;

an enclosure for the driver that provides a back volume which is sealed with respect to acoustic pressure waves produced by the driver and which has dimensions that are much less than wavelengths produced by the driver;

an external microphone located outside the back volume to measure acoustic pressure in a vicinity of the driver;

an internal microphone located inside the back volume to estimate volume velocity;

a computational unit coupled to the external microphone and the internal microphone, the computational unit configured to determine an equalization filter responsive to the external microphone and the internal microphone; and a digital signal processor coupled to the amplifier and the computational unit configured to implement the equalization filter determined by the computational unit.

26. A loudspeaker system comprising:

a driver;

an enclosure for the driver that provides a back volume which is sealed with respect to acoustic pressure waves produced by a driver diaphragm;

an external microphone located outside the back volume;

an internal microphone located inside the back volume;

means for estimating volume velocity for the driver diaphragm using an estimate of instantaneous pressure in the back volume based on a measurement from the internal microphone; and means for determining a transfer function for an equalization filter responsive to the estimate of volume velocity; and a digital signal processor coupled to a signal source and the driver, the digital signal processor configured to implement the equalization filter with the determined transfer function, create a filtered audio signal from the signal source, and provide the filtered audio signal to the driver.

27. The loudspeaker system of claim 26, wherein the means for determining the transfer function for the equalization filter further comprises:

means for determining the transfer function based on a ratio of a target power in a reference acoustic condition and an estimated radiated acoustic power in a current acoustic environment of the loudspeaker system.

28. The loudspeaker system of claim 26, wherein the means for determining the transfer function for the equalization filter further comprises:

means for determining the transfer function based on a ratio of a predetermined radiation impedance and a radiation impedance estimated in a current acoustic environment of the loudspeaker system.

29. The loudspeaker system of claim 28, wherein the predetermined radiation impedance is measured in a reference acoustic condition.

30. The loudspeaker system of claim 28, wherein the predetermined radiation impedance is an average of radiation impedances measured in several acoustic conditions.

* * * * *